US007387499B2

(12) United States Patent
Flanigan

(10) Patent No.: US 7,387,499 B2
(45) Date of Patent: Jun. 17, 2008

(54) SYSTEM AND METHOD FOR TESTING THE OPERATION OF A COOLING FAN

(75) Inventor: Edward P. Flanigan, Burbank, SD (US)

(73) Assignee: Gateway Inc., Irvine, CA (US)

( * ) Notice: Subject to any disclaimer, the term of this patent is extended or adjusted under 35 U.S.C. 154(b) by 371 days.

(21) Appl. No.: 11/201,838

(22) Filed: Aug. 11, 2005

(65) Prior Publication Data

US 2006/0034699 A1 Feb. 16, 2006

Related U.S. Application Data

(60) Provisional application No. 60/601,491, filed on Aug. 13, 2004.

(51) Int. Cl.
*F04B 49/00* (2006.01)

(52) U.S. Cl. ..... 417/42; 417/53

(58) Field of Classification Search ..... 417/18, 417/19, 20, 22, 42, 45, 53, 63, 423.1, 326; 361/694, 695, 678, 704, 689, 676; 702/81–84, 702/132, 142, 100, 109, 113, 138; 324/161, 324/162, 163; 713/300; 700/299–300
See application file for complete search history.

(56) References Cited

U.S. PATENT DOCUMENTS 5,745,041 A * 4/1998 Moss ..... 340/635
5,926,386 A 7/1999 Ott et al.
6,349,385 B1 * 2/2002 Kaminski et al. ..... 713/300
6,400,113 B1 * 6/2002 Garcia et al. ..... 318/463
6,643,128 B2 11/2003 Chu et al.
6,873,883 B2 * 3/2005 Ziarnik ..... 700/300
7,075,261 B2 * 7/2006 Burstein ..... 318/473
7,117,054 B2 * 10/2006 Frankel et al. ..... 700/97

* cited by examiner

*Primary Examiner*—Charles G. Freay
*Assistant Examiner*—Vikansha Dwivedi
(74) *Attorney, Agent, or Firm*—Jeffrey A. Proehl; Woods Fuller Shultz & Smith

(57) ABSTRACT

The present invention is directed to a method for testing the operation of a cooling apparatus of an information handling system. The method may include determining a first rotational speed for operating a fan of the cooling apparatus, with the first rotational speed being less than a maximum rotational speed of the fan. The method includes signaling the fan to rotate at the first rotational speed, and detecting a current rotational speed of the fan. The method includes comparing the detected current rotational speed of the fan to the first rotational speed of the fan, and if the detected current rotational speed is substantially equal to or greater than the first rotational speed of the fan, continuing an initialization process of the information handling system; and if the detected current rotational speed of the fan is less than the first rotational speed, causing further testing of the fan.

19 Claims, 2 Drawing Sheets

System Flow Chart

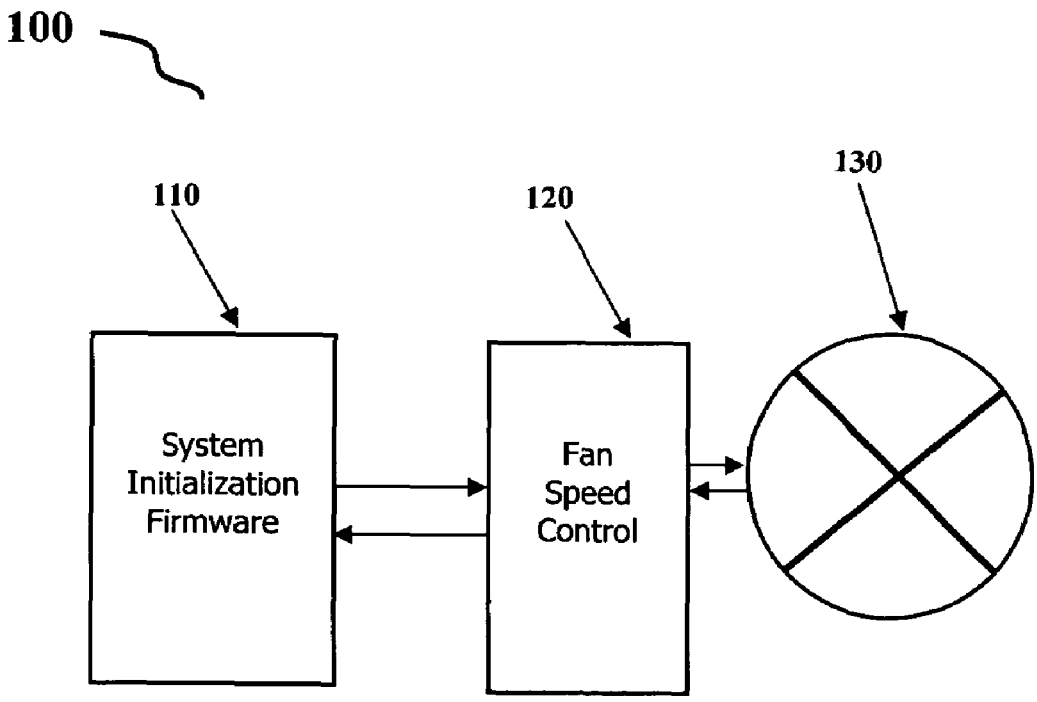
Figure 1 – System Block Diagram

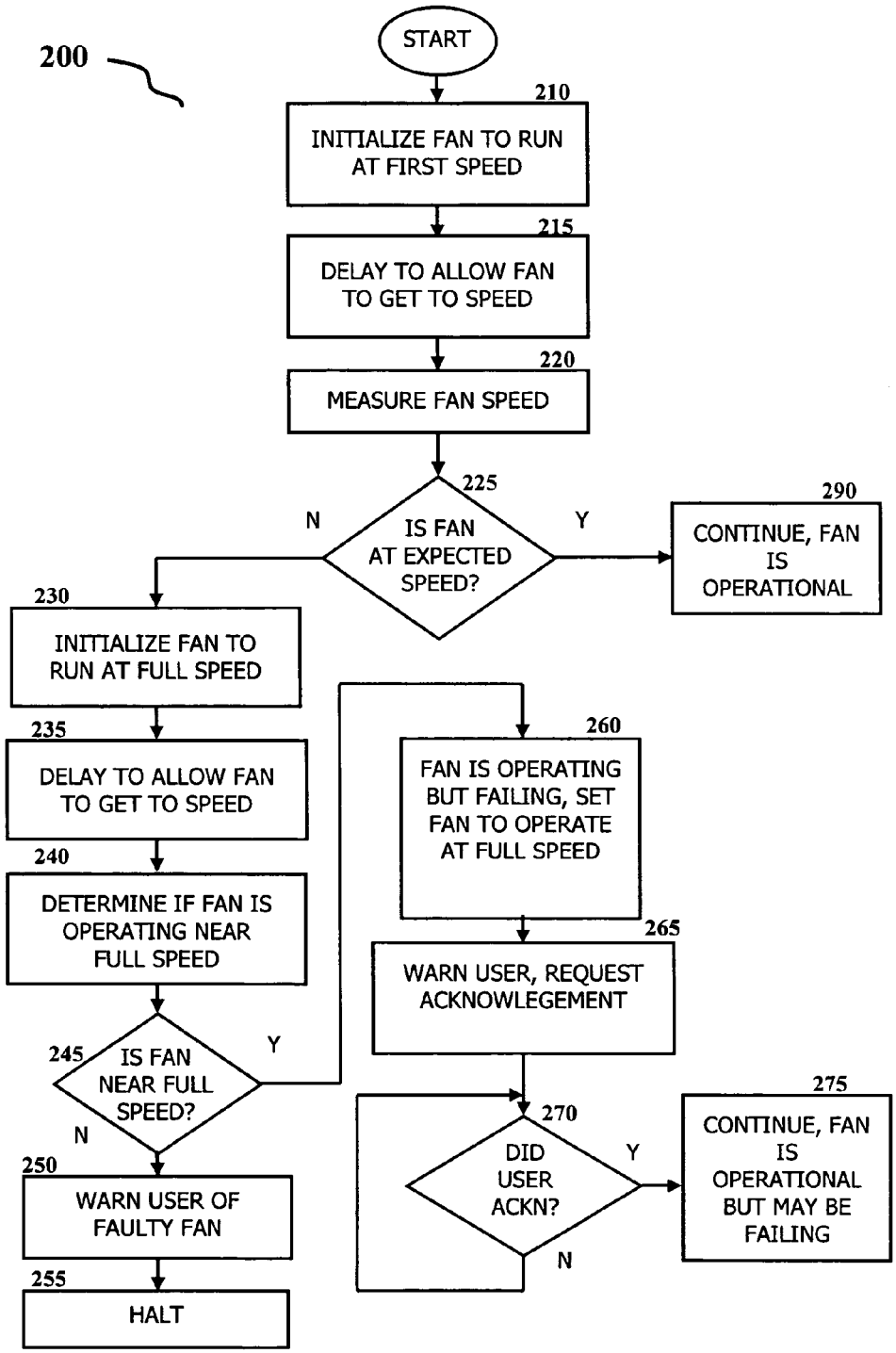
Figure 2 – System Flow Chart

SYSTEM AND METHOD FOR TESTING THE OPERATION OF A COOLING FAN

REFERENCE TO RELATED APPLICATIONS

This application claims the priority of U.S. provisional patent application No. 60/601,491, filed Aug. 13, 2004, which is incorporated herein in its entirety by reference.

FIELD OF THE INVENTION

The present invention generally relates to the field of cooling systems for electronic devices, and particularly to a system and method for determining the operational status of a cooling system during initialization of the electronic device.

BACKGROUND OF THE INVENTION

Electronics devices, such as desktop computers, tower computers, servers, tablet computers, notebook computers and other similar devices utilize various methods and apparatus to reduce thermal build-up, or the accumulation of waste heat, within their chassis. These apparatus sometimes include a cooling device, such as a fan, to circulate air within the chassis and/or exchange air inside the chassis with air external to the chassis to help reduce thermal build-up. However, cooling devices, such as fans, can create problems of their own. These problems include, for example, noise, vibration, and an increased failure rate for the overall cooling system due to the fact that these devices have moving parts.

Previously, when the electronic device has been initialized, the cooling device, or fan, has been operated in order to determine if it was operational. Feedback from the cooling device may have been provided by, for example, a tachometer on the motor of the cooling device to detect the rotational speed of the motor. Heretofore, the cooling device was often tested at full or maximum rotational speed to assure valid operation at that speed, which contributed to the noise and vibration generated by the system at system start-up. If it was detected that the full rotational speed could not be attained, an error message was displayed and operation of the system was halted to prevent potential loss of data or damage to the system due to poor or nonexistent cooling.

Therefore, it would be desirable to provide a system and method for testing the operation of a cooling device, or fan, in a manner that avoids the high level of noise and vibration generated by the fan at full rotational speed while still being capable of determining the operational status of the fan, and, in those cases where it has been determined that the fan cannot reach maximum cooling capacity, but may still be capable of providing sufficient cooling. The invention may allow the electronic device to operate at some range of operating levels supportable by the reduced cooling capacity of the fan at a lower rotational speed.

SUMMARY OF THE INVENTION

Accordingly, the present invention is directed to a system and method for testing the operation of a cooling device for an electronic device, such as a cooling fan. The present invention may allow testing of the cooling device at relatively lower speeds than the maximum operational speed of the cooling device, and thereby reducing noise generated by the cooling device during initialization and testing of the electronic device. Furthermore, the present invention may inform the user of a failing cooling device, while still permitting use of the electronic device when the cooling device is only able to provide less than an optimal level of cooling to the electronic device.

In one aspect of the present invention, a method is disclosed for testing the operation of a cooling apparatus of an information handling system,. The method may include determining a first rotational speed for operating a fan of the cooling apparatus, with the first rotational speed being less than a maximum rotational speed of the fan. The method may further include signaling the fan to rotate at the first rotational speed, and detecting a current rotational speed of the fan. The method may also include comparing the detected current rotational speed of the fan to the first rotational speed of the fan, and if the detected current rotational speed is substantially equal to or greater than the first rotational speed of the fan, continuing an initialization process of the information handling system; and if the detected current rotational speed of the fan is less than the first rotational speed, causing further testing of the fan.

In another aspect of the present invention, a system for implementing the aforedescribed method is disclosed.

It is to be understood that both the foregoing general description and the following detailed description are exemplary and explanatory only and are not restrictive of the invention as claimed. The accompanying drawings, which are incorporated in and constitute a part of the specification, illustrate an embodiment of the invention and together with the general description serve to explain the principles of the invention.

BRIEF DESCRIPTION OF THE DRAWINGS

The numerous advantages of the present invention may be better understood by those skilled in the art by reference to the accompanying figures in which:

FIG. 1 is a system block diagram of the system initialization software (or firmware) and fan speed control.

FIG. 2 is a flow chart of the fan test system.

DETAILED DESCRIPTION OF THE INVENTION

Reference will now be made in detail to the presently preferred embodiments of the invention, examples of which are illustrated in the accompanying drawings.

Referring generally now to FIGS. 1 through 2, exemplary embodiments of the present invention are shown wherein a system and method for changing the operating characteristics of a system 100, such as an information handling system, based upon the operational status of the cooling apparatus of the system is disclosed.

Generally, the invention comprises a method of operating the cooling apparatus, and a system implementing the method of operating the cooling apparatus, that determines the cooling capability of the cooling apparatus, and is highly suitable for implementing as a part of an initialization process or procedure for an information handling system, but may also be used at other points in time after the initialization process of the information handling system. The invention is illustratively described in terms of a cooling fan of a cooling apparatus of an information handling system, although application to a cooling apparatus utilizing other devices other than fans may also be used.

Referring to FIG. 1, a system block diagram of the system initialization software (or firmware) and a fan speed control is shown. The system initialization firmware 110 may be any software or code that is used to initialize a system into an operating state, and usually performs some level of testing as initialization is being performed. An example of this system initialization firmware 110 is the BIOS (Basic Input Output System) software which initializes the processor, memory, storage and other components and peripherals in many computer systems. Additionally, the BIOS performs tests on various devices during initialization, and these tests are often referred to as the POST (Power On Self Test). During the POST, tests are performed to provide reasonable assurance that the processor, memory, storage devices and peripherals are operational. In some embodiments of the POST, errors are reported as messages on a display during the initialization and testing, or are optionally signaled using beep codes when a display for the verbal messages is unavailable. In the present embodiment, additional tests may be added to the tests of the POST that are directed to the testing of the cooling apparatus of the system, such as a cooling apparatus that includes one or more cooling fans.

As a part of the POST or other testing or initialization of the system at start up, the system initialization firmware 110 may initiate operation of the cooling fan at a specified rotational speed by sending commands to the fan speed control 120, which controls the rotational speed of the cooling fan 130. The fan speed control 120 directs the cooling fan to run or operate at the speed indicated by the system initialization firmware 110. The rotational speed specified by the firmware 110 is preferably less than the maximum operating rotational speed of the cooling fan 130, which reduces the noise produced by the fan and thus the noise produced by the information handling system, as well as reducing wear on the cooling fan. The specified rotational speed may be a predetermined rotational speed, or may be varied by the firmware 110 according to various factors present on the information handling system. For example, the specified rotational speed may fall within a range of approximately 50% to approximately 90% of the maximum rotational speed, although other fractions of the maximum rotational speed out side of this range may also be employed as the specified speed.

The system initialization firmware 110 may pause for a predetermined period of time to allow the cooling fan 130 to spin up and achieve the specified rotational speed. After waiting for the predetermined period of time, the firmware 110 may send another command to the fan speed control 120 that requests detection of the current rotational speed of the cooling fan 130. The fan speed control 120 may perform a tachometer measurement of the speed of the cooling fan 130 after receiving the command, or optionally may measure the speed of the fan 130 by other means including, but not limited to, optical interrupters and reed switches, which are known to those skilled in the art. Optionally, rather than making a single measurement of the rotational speed at the end of the predetermined period of time, the fan speed control 120 may continuously monitor the rotational speed of the fan for some portion of the predetermined period of time to detect if the fan reaches the specified rotational speed at any point during the period.

Once a rotational speed of the cooling fan is measured, the operating speed information is returned to system initialization firmware 110 for analysis. If the returned rotational speed information is a speed that is less than expected, e.g., less than the specified rotational speed, or less than some tolerance range of rotational speed below the specified rotational speed, the firmware 110 may interpret that there is a problem with the cooling fan, such as the fan has failed, is failing, or is otherwise prevented from proper operation by factors such as dirt buildup on the fan, blockage of air flow vents, and the like. An error message may be displayed on a screen of the information handling system to inform the user of the problem. Optionally, a second rotational speed for the fan 130 may be requested by the firmware 110 through the fan speed control 120. After a second period of delay following the second request to allow the fan 130 to reach the requested speed, the system initialization firmware 110 may again request a detection of the current speed of the fan 130 from the fan speed control 120.

If the rotational speed reported back to the firmware 110 after the second delay period is greater than a predetermined threshold rotational speed, it may be determined that the cooling fan is operating at a level of reduced effectiveness. Preferably, the predetermined threshold rotational speed corresponds to a minimum level of cooling that provides sufficient heat removal from the information handling system to maintain a minimum level of operation of the system to perform some operations, such as saving and backing up data or other operations that will enable shut down of the system for making repairs or replacements on the system. The user may be provided information on the nature and/or effect of the problem through one or messages provided on the display of the information handling system. Optionally, the user may be requested or required to acknowledge the problem before the system proceeds further with the system initialization process. The user may acknowledge the fact that the cooling system is malfunctioning and there may be a possibility of a thermal shutdown of the system, along with the related potential of loss of data. As a further option, the user may be instructed to take certain actions, such as, for example, saving or backing up data to a safe location, checking the vents of the information handling system for blockages, checking for dirt or dust buildup on the fan, as well as taking other actions to prevent the loss of data or to possibly remedy the problem. However, if the speed reported by the fan speed control 120 is below the predetermined threshold rotational speed, the system initialization firmware 110 may determine that the cooling fan 130 is not able to operate at a speed that may provide sufficient cooling for any level of operation of the information handling system. In this case, an error message may be displayed to inform the user of the circumstances, and the initialization of the system may be stopped.

Referring to FIG. 2, a flow chart of an exemplary operation process of the system initialization software (or firmware) for initialization and testing of a cooling apparatus is shown. In this exemplary operation, the automatic fan speed control may be temporarily disabled, and the firmware may attempt to initiate fan operation (block 210) at a specified first predetermined speed by sending commands to the fan speed control 120, and the first predetermined speed may be less the maximum operating speed for the fan to reduce noise, and wear on the fan, such as approximately 50% of the maximum operating speed of the fan. A delay may be provided to allow the fan 130 to reach the first predetermined speed specified by the firmware (block 215). The current rotational speed of the fan 130 may be measured (block 220). The measured speed may be compared by the firmware with the specified speed (block 225). Optionally, a message may be displayed to a user that indicates that the testing is occurring, such as, for example, "Checking system cooling fan operation, please wait." If the measured speed is approximately at the specified speed, or possibly higher, or possibly slightly lower, the firmware may determine that the fan appears to be operational (block 290), and therefore the system initialization process may continue. Note that the measured speed may be somewhat lower than the first predetermined speed specified by the firmware and the fan may still be considered to be fully operational. For example, if the first predetermined speed is 50% of the maximum rotational speed, then an acceptable speed for continuing the initialization process of the information handling system may be anything over 45% of the maximum rotational speed. If the measured speed (block 220) is less than the range of acceptable predetermined rotational speeds, the fan may be failing and the fan may then be directed to operate at full or maximum rotational speed (block 230). A delay may be provided to allow the fan to attempt to reach the maximum rotational speed (step 235). The actual rotational speed of the cooling fan may then be measured (block 240), and it may then be determined if the measured rotational speed of the fan is within a range that is capable of providing adequate cooling for the information handling system. This determination may be performed by comparing the actual operating speed of the fan with a predetermined threshold rotational speed. If the actual operating speed is above this predetermined threshold speed, it may be determined (block 245) that the fan is operating at a speed that it is capable of providing sufficient cooling for the information handling system, but the cooling fan still has the potential of failing. If it is determined that the fan is not operating above the predetermined threshold rotational speed (block 245), the user may be warned that the fan is failing (block 250) and the initialization or operation of the system may be discontinued to prevent additional problems.

If it is determined that the fan is operating above the predetermined threshold rotational speed (block 245), the fan is set to operate at full speed if not already instructed to operate at full speed (block 260) so that it will operate at its maximum rotational capability, which may not be the originally specified capacity of the fan, but may provide adequate cooling of the information handling system for most conditions. The user may be warned through a displayed message that the fan is failing (block 265) and may not be providing adequate cooling, and the user may be requested to acknowledge this situation. The firmware may wait for the user to acknowledge the problem (block 270), and upon such acknowledgement, the system initialization may be continued (block 275). At this point, the fan may be locked into operating at or close to its maximum rotational speed to help provide as much cooling to the information system as possible, even if the operating system software of the information handling system detects temperatures that would normally slow down or shut off operation of the cooling fan, thus overriding this operating system control of the fan.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A method for testing the operation of a cooling apparatus of an information handling system, the method comprising:

beginning an initialization process of the information handling system;

signaling a fan of the cooling apparatus to rotate at a first rotational speed that is less than a maximum rotational speed of the fan, detecting a current rotational speed of the fan;

comparing the detected current rotational speed of the fan to the first rotational speed of the fan; and if the detected current rotational speed is substantially equal to or greater than the first rotational speed of the fan, continuing the initialization process of the information handling system; and if the detected current rotational speed of the fan is less than the first rotational speed, causing further testing of the fan.

2. The method of claim 1 additionally comprising the step of waiting for a first delay period after signaling the fan to rotate at the first rotational speed to allow the fan to attempt to reach the first rotational speed.

3. The method of claim 1 additionally comprising the step of predetermining the first rotational speed for operating the fan of the cooling apparatus.

4. The method of claim 1 wherein the first rotational speed is between approximately 50% and approximately 90% of the maximum rotational speed of the fan.

5. The method of claim 1 wherein the step of further testing of the fan comprises:

signaling the fan to rotate at a second rotational speed;

detecting a second current rotational speed of the fan;

comparing the second current rotational speed of the fan to a predetermined threshold rotational speed of the fan, wherein the predetermined threshold rotational speed of the fan comprises a minimum rotational speed for providing a sufficient level of cooling to the information handling system for the information handling system to operate; and if the second current rotational speed is substantially equal to or greater than the predetermined threshold rotational speed, continuing the initialization process of the information handling system;

if the second current rotational speed is less than the threshold rotational speed, discontinuing the initialization process of the information handling system.

6. The method of claim 5 wherein the second rotational speed comprises the maximum rotational speed for the fan.

7. The method of claim 5 additionally comprising the step of waiting for a second delay period after signaling the fan to turn at the second rotational speed to allow the fan to attempt to reach the second rotational speed.

8. The method of claim S wherein the step of continuing the initialization process includes notifying a user of the information handling system of a reduced cooling capability of the cooling apparatus of the information handling system.

9. A system for testing the operation of a cooling apparatus of an information handling system, the system comprising:

means for beginning an initialization process of the information handling system;

means for signaling a fan of the cooling apparatus to rotate at a first rotational speed that is less than a maximum rotational speed of the fan, means for detecting a current rotational speed of the fan;

means for comparing the detected current rotational speed of the fan to the first rotational speed of the fan;

means for continuing the initialization process of the information handling system, if the detected current rotational speed is substantially equal to or greater than the first rotational speed of the fan; and means for causing further testing of the fan, if the detected current rotational speed of the fan is less than the first rotational speed.

10. The system of claim 9 additionally comprising means for predetermining the first rotational speed for operating the fan of the cooling apparatus.

11. The system of claim 9 wherein the means for detecting the current speed of the fan is configured to wait for the first delay period after the means for signaling the fan has signaled the fan to rotate at the first rotational speed to allow the fan to attempt to reach the first rotational speed.

12. The system of claim 9 wherein the first rotational speed is between approximately 50% and approximately 90% of the maximum rotational speed of the fan.

13. The system of claim 9 wherein the means for causing further testing of the fan comprises:

means for signaling the fan to rotate at a second rotational speed;

means for detecting a second current rotational speed of the fan;

means for comparing the second current rotational speed of the fan to a predetermined threshold rotational speed of the fan, wherein the predetermined threshold rotational speed of the fan comprises a minimum rotational speed for providing a sufficient level of cooling to the information handling system for the information handling system to operate; and means for continuing the initialization process of the information handling system if the second current rotational speed is substantially equal to or greater than the predetermined threshold rotational speed;

means for discontinuing the initialization process of the information handling system if the second current rotational speed is less than the threshold rotational speed.

14. The system of claim 13 wherein the second rotational speed comprises the maximum rotational speed for the fan.

15. The system of claim 13 wherein the means for detecting the second current rotational speed is configured to wait to detect the second current rotational speed until after a second delay period after the means for signaling signals the fan to turn at the second rotational speed to allow the fan to attempt to reach the second rotational speed.

16. The system of claim 13 additionally comprising means for notifying a user of the information handling system of a reduced cooling capability of the cooling apparatus of the information handling system.

17. A method for testing the operation of a cooling apparatus of an information handling system, the method comprising:

beginning an initialization process of the information handling system;

signaling the cooling apparatus to operate at a first operating rate that is less than a maximum operating rate of the cooling apparatus, the maximum operating rate of the cooling apparatus corresponding to a maximum cooling rate of the cooling apparatus;

detecting a current operating rate of the cooling apparatus;

comparing the detected current operating rate of the cooling apparatus to the first operating rate of the cooling apparatus; and if the detected current operating rate of the cooling apparatus is substantially equal to or greater than the first operating rate of the cooling apparatus, continuing the initialization process of the information handling system; and if the detected current operating rate of the cooling apparatus is less than the first operating rate, causing further testing of the cooling apparatus to be performed.

18. The method of claim 17 wherein the step of further testing of the cooling apparatus comprises:

signaling the cooling apparatus to operate at a second operating rate;

detecting a second current operating rate of the cooling apparatus;

comparing the second current operating rate of the cooling apparatus;

comparing the second current operating rate of the cooling apparatus to a predetermined threshold operating rate of the cooling apparatus, wherein the predetermined threshold operating rate of the cooling apparatus comprises a minimum operating rate for providing a sufficient level of cooling to the information handling system for the information handling system to operate; and if the second current operating rate is substantially equal to or greater than the predetermined threshold operating rate, continuing the initialization process of the information handling system;

if the second current operating rate is less than the threshold operating rate, discontinuing the initialization process of the information handling system.

19. The method of claim 17 wherein the cooling apparatus includes a cooling fan, and the operating rate of the cooling apparatus comprises a rotational speed of the cooling fan.

* * * * *